US011135710B2

(12) United States Patent
McDonald

(10) Patent No.: US 11,135,710 B2
(45) Date of Patent: Oct. 5, 2021

(54) COMPACT EXCAVATOR AND SKID STEER LOADER AUXILIARY HYDRAULIC COUPLER INSTALLER TOOL

(71) Applicant: Steven Alan McDonald, Forestville, CA (US)

(72) Inventor: Steven Alan McDonald, Forestville, CA (US)

( * ) Notice: Subject to any disclaimer, the term of this patent is extended or adjusted under 35 U.S.C. 154(b) by 0 days.

(21) Appl. No.: 16/727,318

(22) Filed: Dec. 26, 2019

(65) Prior Publication Data

US 2021/0197349 A1 Jul. 1, 2021

(51) Int. Cl.
*B25B 27/00* (2006.01)
*B25B 27/02* (2006.01)

(52) U.S. Cl.
CPC ..... *B25B 27/02* (2013.01)

(58) Field of Classification Search
CPC .... B25B 1/00; B25B 3/00; B25B 5/00; B25B 21/00; B25B 27/00; B25B 33/00
See application file for complete search history.

(56) References Cited

U.S. PATENT DOCUMENTS 3,846,891 A * 11/1974 Elg ..... B25B 27/062 29/261
5,544,402 A * 8/1996 O'Neil ..... B25B 27/02 29/261
2009/0064829 A1* 3/2009 Frank ..... B25F 5/006 81/489
2010/0050822 A1* 3/2010 Wilson, Jr. ..... B25B 13/107 81/121.1
2012/0151735 A1* 6/2012 Thomas ..... F16C 35/00 29/426.5

* cited by examiner

*Primary Examiner* — Lee D Wilson

(57) ABSTRACT

The 'Compact Excavator & Skid Steer Loader Auxiliary Hydraulic Coupler Installer Tool' is designed as a handheld tool for the purpose of mechanically installing high pressure auxiliary hydraulic attachment couplings on Compact Excavators & Skid Steer Loaders. The uniqueness of the tool is that it provides a safe, clean, fast and simple alternative to the use of hand wrenches, drip pans, rags and additional environmental cleanup materials that are required when attaching hydraulically driven auxiliary attachments to compact excavators and skid steer loaders. The tool consists of 4 basic components. The handle, anchor, attachment head and forcing head. The single anchor tool handle provides the base from which multiple tools can be configured to fit any attachment or machine application by using one of the 2 anchors and one of the 3 attachment heads with one of the 3 forcing heads.

1 Claim, 32 Drawing Sheets

Compact Excavator & Skidsteer Loader Auxiliary Hydraulic Coupler Installer Tool

Drawing #2

Compact Excavator & Skidsteer Loader Auxiliary Hydraulic Coupler Installer Tool / with dual pivot anchors

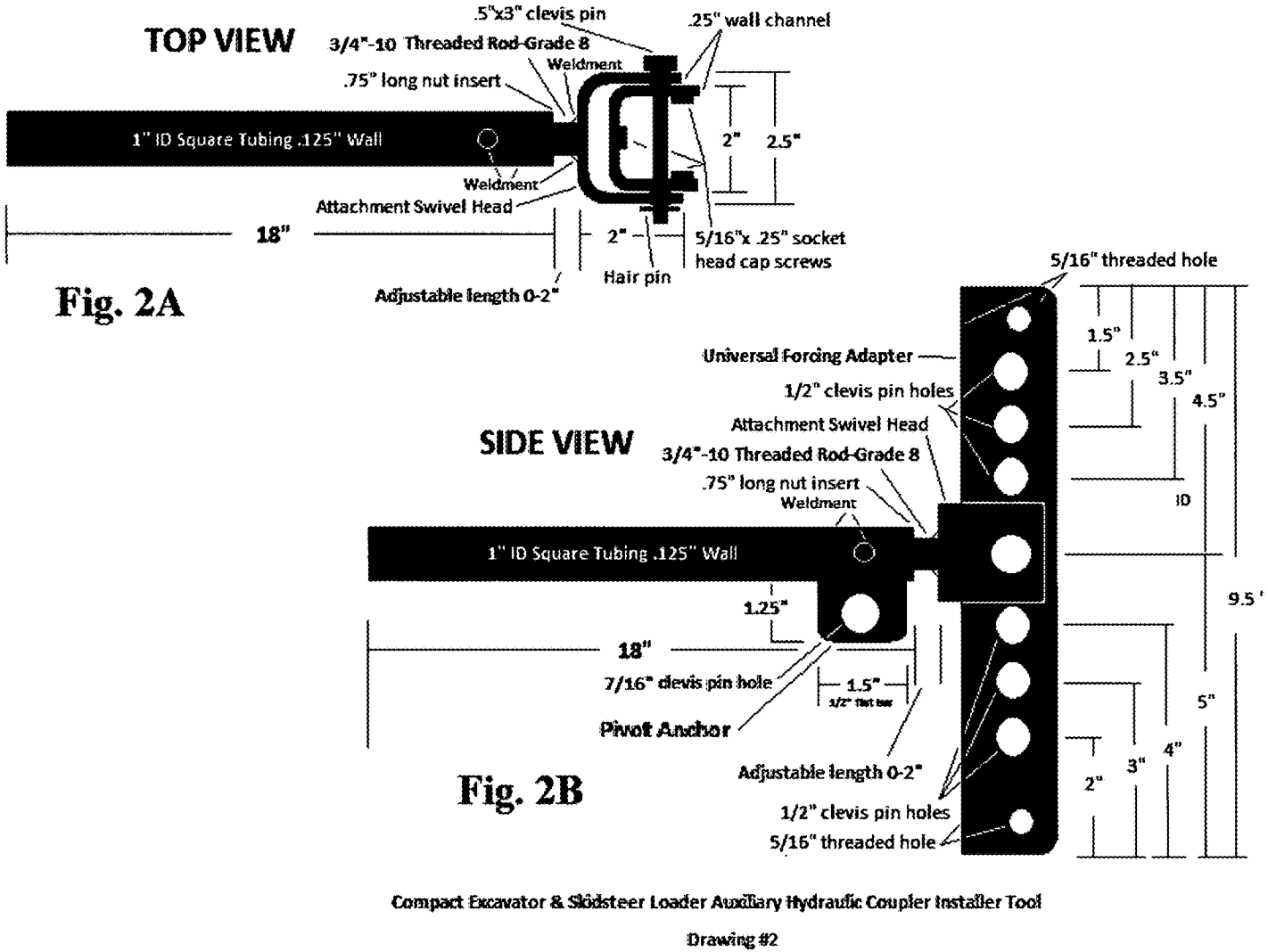
TOP VIEW
.25" wall channel
.5"x3" clevis pin
3/4"-10 Threaded Rod-Grade 8
Weldment
.75" long nut insert
1" ID Square Tubing .125" Wall
Weldment
Attachment Swivel Head
2"
2.5"
5/16"x .25" socket head cap screws
2"
Hair pin
Adjustable length 0-2"
18"
Fig. 2A
SIDE VIEW
5/16" threaded hole
1.5"
2.5"
3.5"
4.5"
ID
9.5'
5"
4"
3"
2"
Universal Forging Adapter
1/2" clevis pin holes
Attachment Swivel Head
3/4"-10 Threaded Rod-Grade 8
.75" long nut insert
Weldment
1" ID Square Tubing .125" Wall
1.25"
18"
7/16" clevis pin hole
Pivot Anchor
1.5"
Adjustable length 0-2"
1/2" clevis pin holes
5/16" threaded hole
Fig. 2B
Compact Excavator & Skidsteer Loader Auxiliary Hydraulic Coupler Installer Tool
Drawing #2

Handle and Pivot Anchors
Drawing #4

Attachment Angled Swivel Head

Drawing #5

Attachment Swivel Head
With Bushings
Drawing #6

Attachment Swivel Head
No Bushings
Drawing #7

Single Duty Fording Adapter

Drawing #8

Swiveling Single Duty Fording Adapter

Drawing #9

Universal Forcing Head

Drawing #10

"J" Hook Attachment

1/2" NPT Case Drain Coupling

Handle Pivot Anchor

End Pivot Anchor

Bent Clevis Pin

1/2"x 1/2" Clevis Pin

3/32" Hairpin

1/2" Extended Tip Set Screw

3/4" x 4" Gade 8 Stud

1/2" Flange Nut

1/2" Tall Nut

3/4" Tall Nut

5/16"x 1/4" Allen Bolt

1/2"x 2-1/2" Clevis

1/2" x 4" Clevis

1/2" ID x 5/8" OD Bushing

1/2" NPT - 1/2"-13 Threaded Adapter

COMPACT EXCAVATOR AND SKID STEER LOADER AUXILIARY HYDRAULIC COUPLER INSTALLER TOOL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE. OR A COMPUTER PROGRAM LISTING COMPACT DISC APPLICATION

Not Applicable.

BACKGROUND OF INVENTION

The 'Compact Excavator & Skid Steer Loader Auxiliary Hydraulic Coupler Installer Tool' (FIG. 1A-FIG. 1B and FIG. 2A-FIG. 2B) is designed as a handheld tool for the purpose of mechanically installing high pressure auxiliary hydraulic attachment couplings on Compact Excavators & Skid Steer Loaders. The purpose of the tool is to provide a clean, fast and simple alternative to the use of wrenches, drip pans, rags and additional environmental cleanup materials required when attaching hydraulically driven auxiliary attachments to Compact Excavators & Skid Steer Loaders.

BRIEF SUMMARY OF INVENTION

The tool consists of 4 base components that are able to be assembled into two different tools Tool' (FIG. 1A-FIG. 1B and FIG. 2A-FIG. 2B). 1. The 'Dual Pivot Anchor' (FIG. 1A-FIG. 1B) tool. 2. The 'Single Pivot Anchor' (FIG. 2A-FIG. 2B) tool. The 4 base components are. 1. The 'Handle' (FIG. 3A-FIG. 3B) with an attachment pivot anchor (FIG. 12A—FIG. 12B) and a threaded swivel point (FIG. 3A-FIG. 3B). 2. The 'Attachment Swivel Head' that is available in three configurations to choose from (angled swivel head (FIG. 4A-FIG. 4B), swivel head with bushings (FIG. 5A-FIG. 5B) and swivel head without bushings (FIG. 6A-FIG. 6B)). 3. The 'Forcing Head' that is available in three configurations to choose from (single duty (FIG. 7A-FIG. 7B), swiveling single duty (FIG. 8A-FIG. 8B) and universal (FIG. 9A-FIG. 9B—FIG. 9C)). 4. The machine 'Attachment' that has two configurations to choose from ("J" hook (FIG. 10A-FIG. 10B) or coupling (FIG. 11)). These options allow the user to configure the tool to their specific application and needs. The interchangeable attachments are fully adjustable and interchangeable to provide a fit to any attachment, hydraulic coupler and compact excavator or skid steer loader applications.

The tool has the ability to be assembled in 3 different basic configurations and by simply adding attachments and/or forcing head options to the tool, the user has the ability to install every coupler available on the market made to be install on every compact excavator or skid steer loader on the market with any attachment desired.

BRIEF DESCRIPTION OF THE SEVERAL VIEWS OF THE DRAWINGS

Description of Figures

Figure 1A:
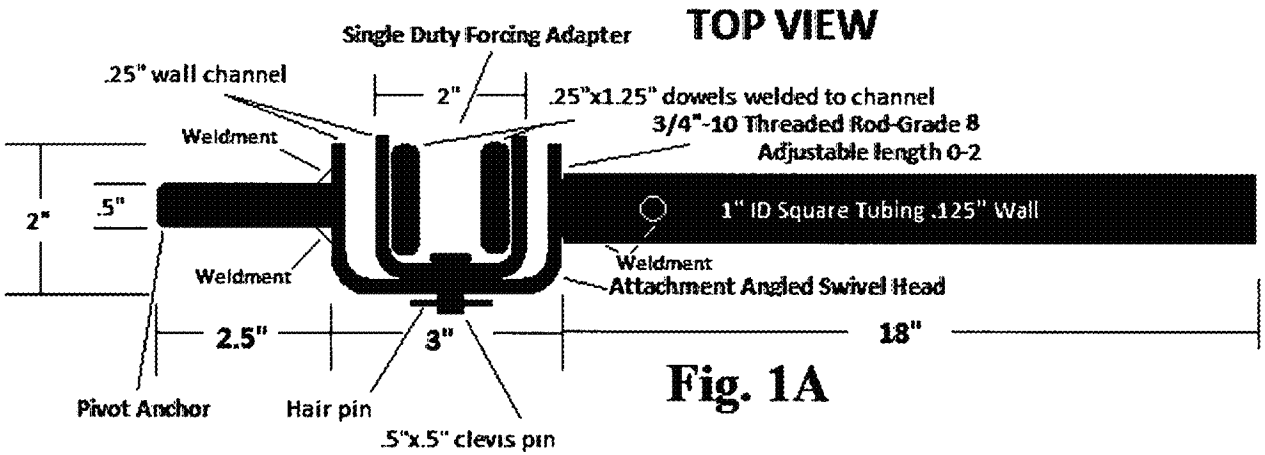
Figure 1B:
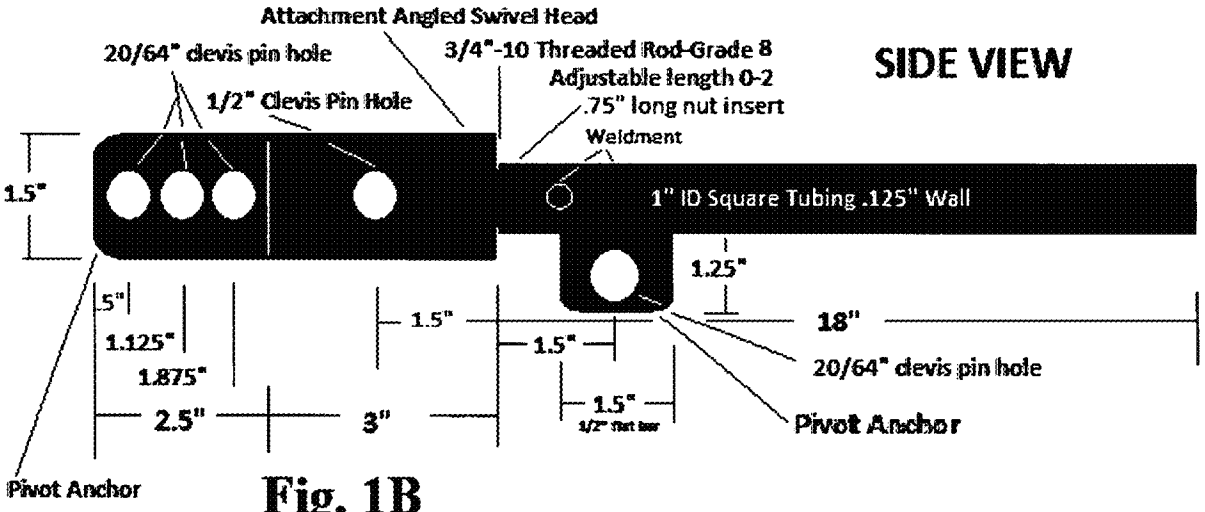

FIG. 1A is a top view of the compact excavator and skid steer loader auxiliary hydraulic coupler installer tool of the present invention, shown here in a dual pivot anchor configuration, having an angled swivel head attached to the handle and a single duty forcing adapted attached to the angled swivel head;

FIG. 1B is a side view in elevation thereof.

FIG. 2A is a top view of the inventive tool configured with a swivel head attached to the tool handle and a universal forcing adapter attached to the swivel head;

FIG. 2B is a side view in elevation thereof.

Figure 3B:
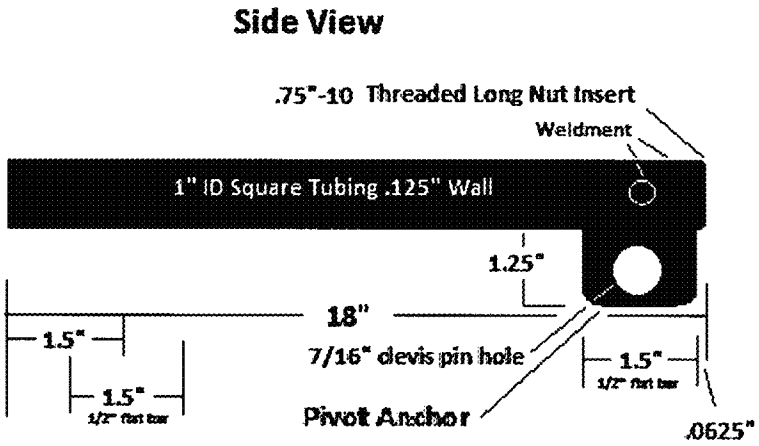
Figure 3A:
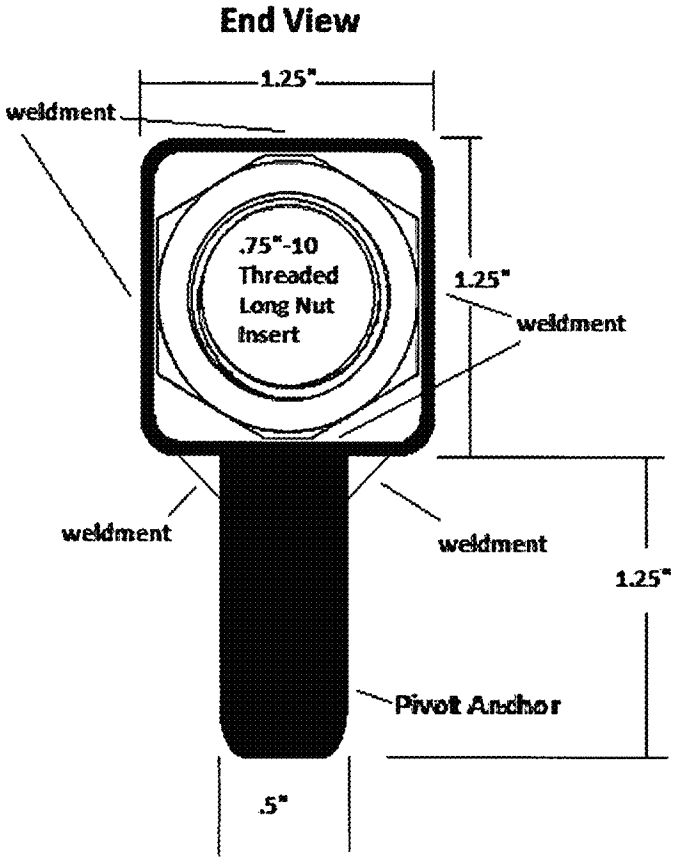

FIG. 3A is a distal end view of the handle of the present invention, showing the pivot anchor welded to the underside of the handle;

FIG. 3B is a side view in elevation thereof.

Figure 4A:
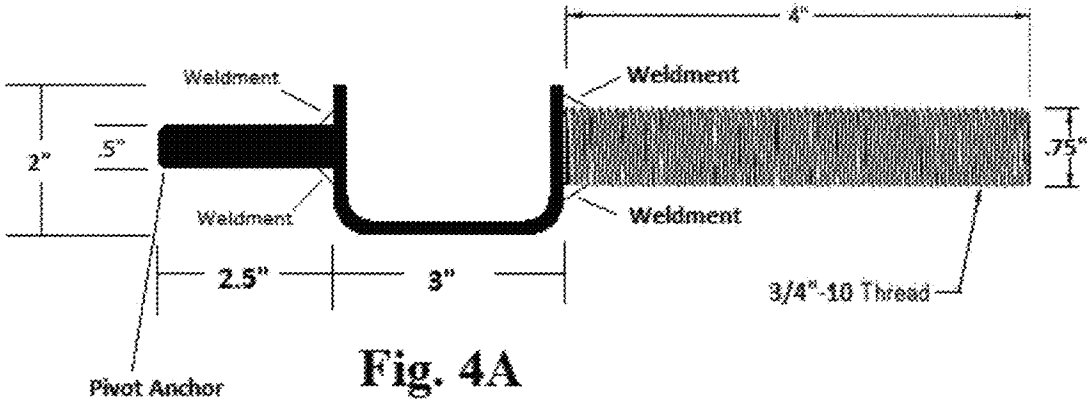
Figure 4B:
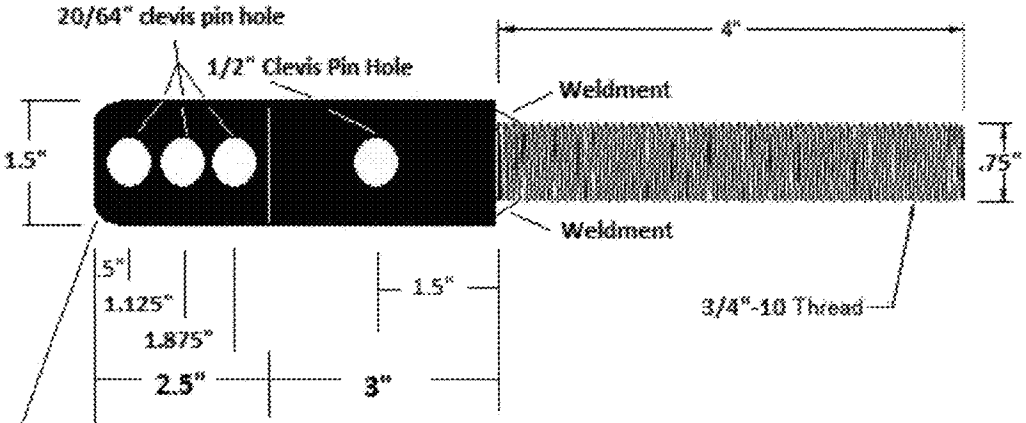

FIG. 4A is a top view of the attachment angled swivel head;

FIG. 4B is a side view in elevation thereof.

Figure 5A:
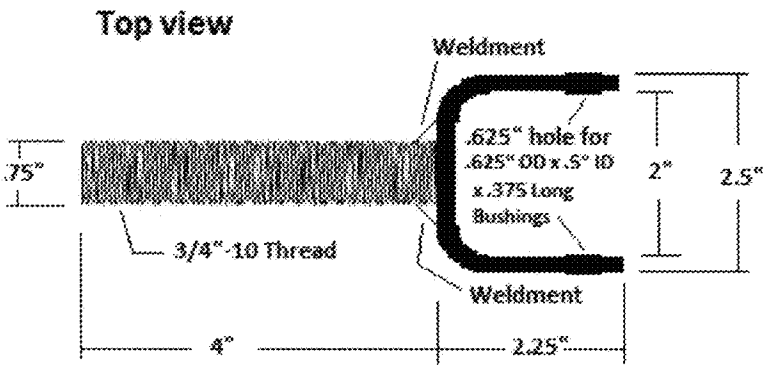
Figure 5B:
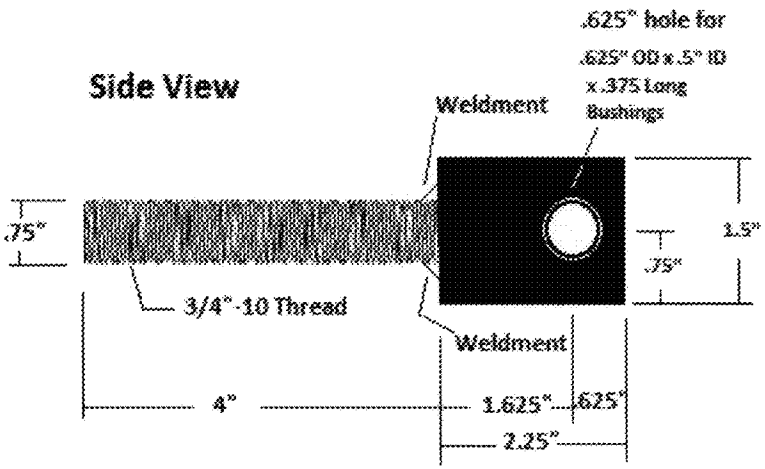

FIG. 5A is a top view of the attachment swivel head with bushings;

FIG. 5B is a side view in elevation thereof.

Figure 6A:
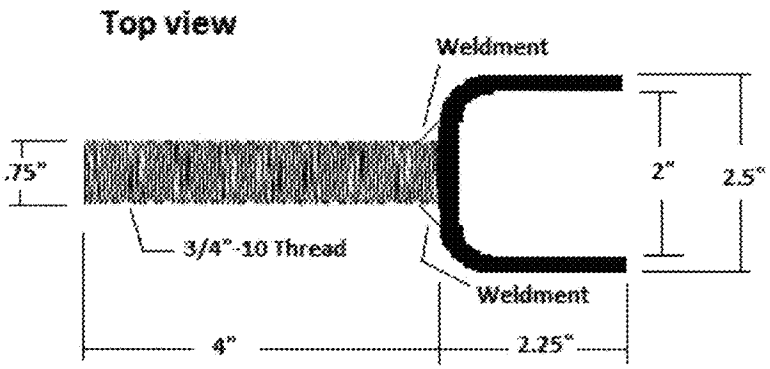
Figure 6B:
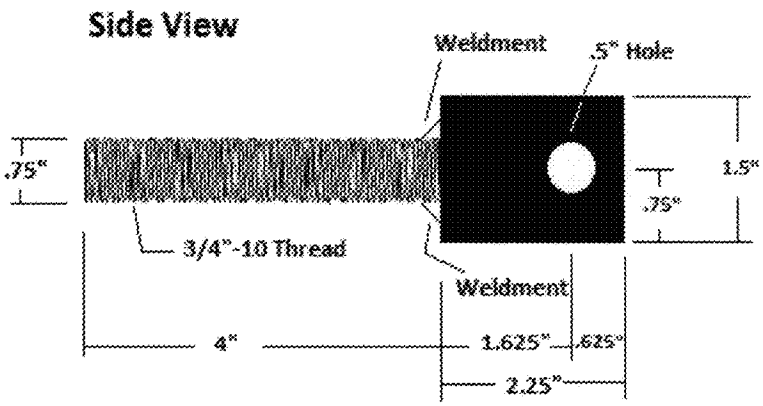

FIG. 6A is a top view of the attachment swivel head with no bushings;

FIG. 6B is a side view in elevation thereof.

Figure 7B:
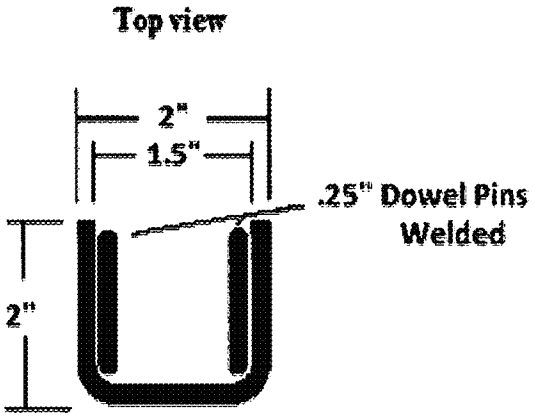
Figure 7A:
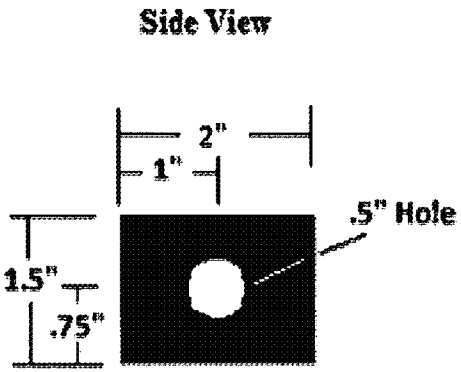

FIG. 7A is a side view in elevation of the single duty forcing adapter;

FIG. 7B is a top view thereof.

Figure 8A:
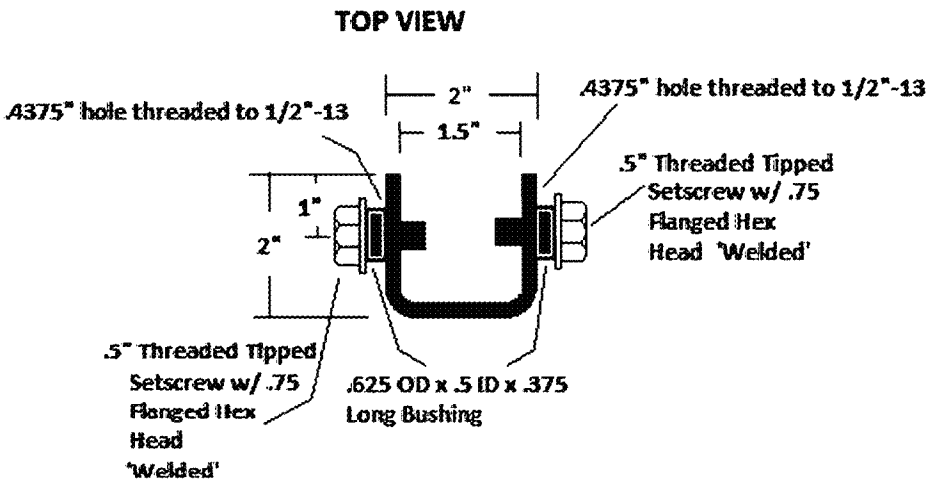
Figure 8B:
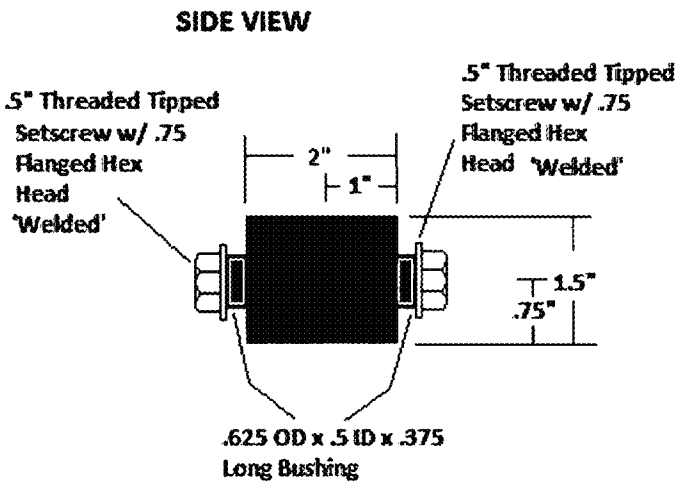

FIG. 8A is a side view in elevation of the swiveling single duty forcing adapter of the present invention;

FIG. 8B is a top view thereof.

Figure 9C:
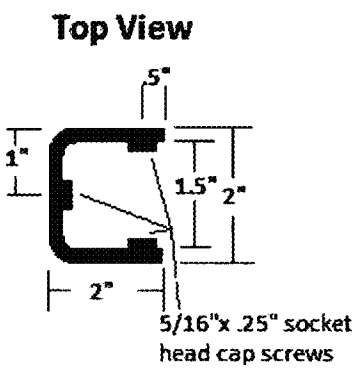
Figure 9B:
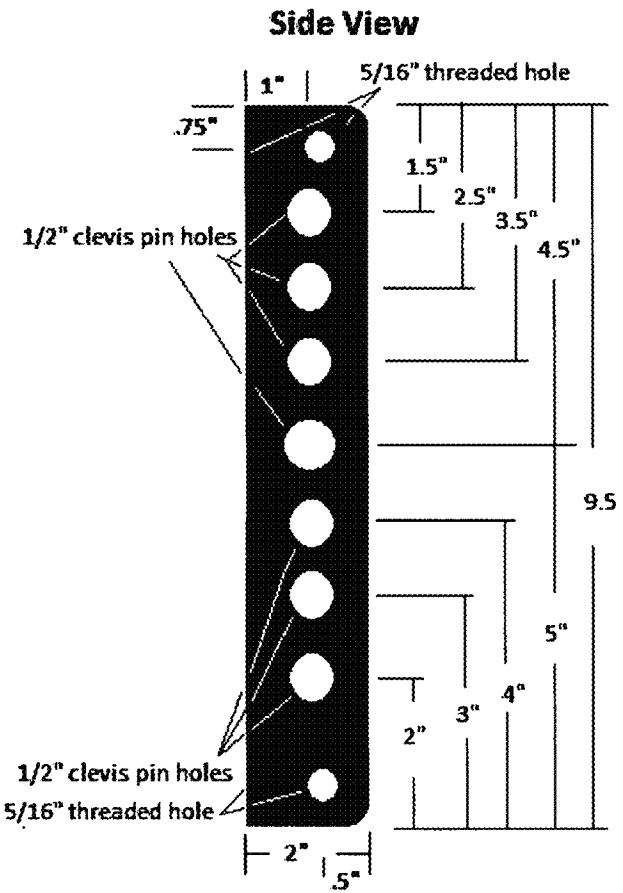
Figure 9A:
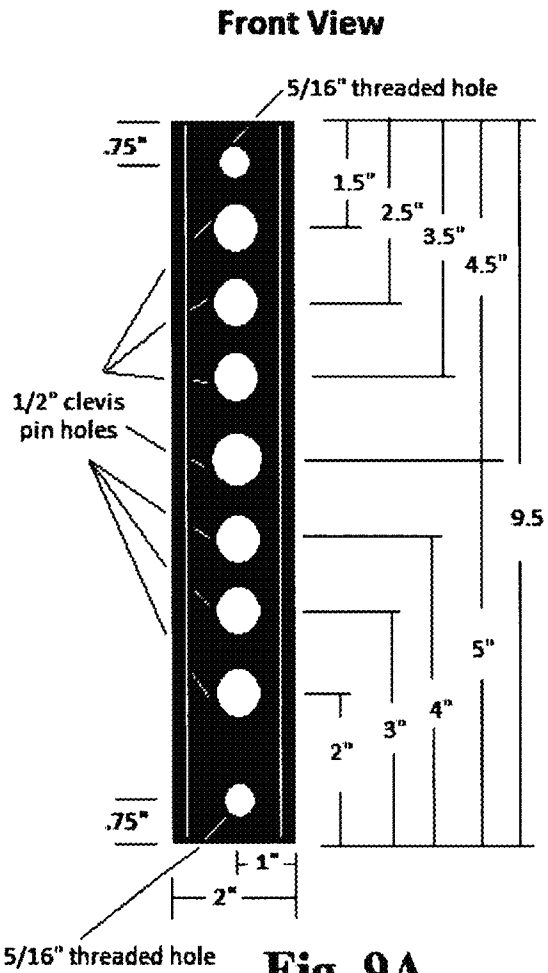

FIG. 9A is a front view of the universal forcing head;

FIG. 9B is a side view in elevation thereof;

FIG. 9C is a top view thereof.

Figure 10A:
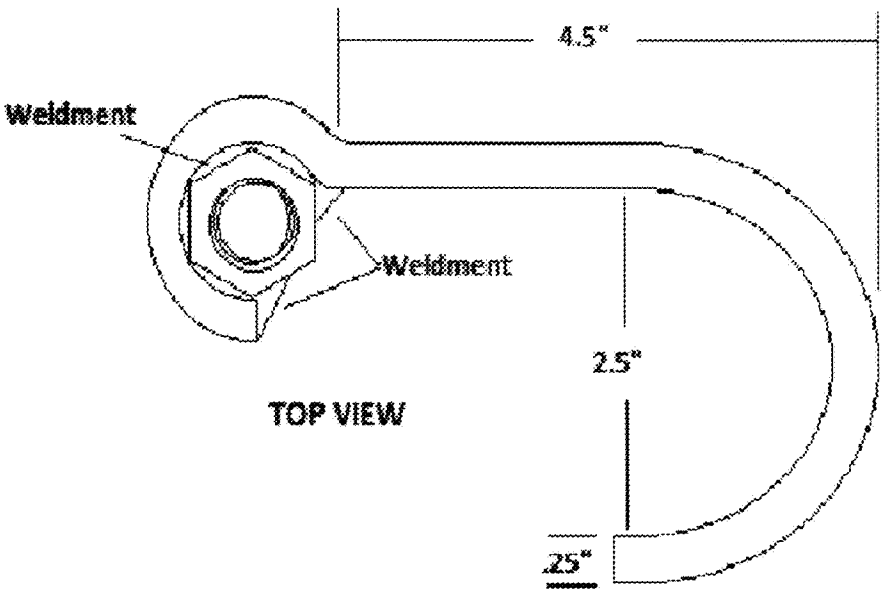
Figure 10B:
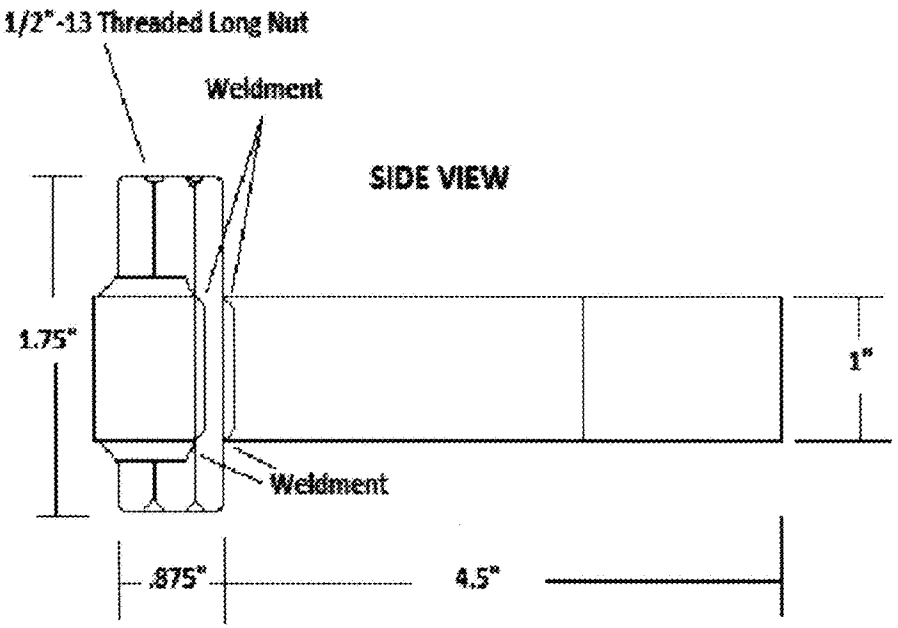

FIG. 10A is a top view of the "J" hook attachment of the present invention;

FIG. 10B is a side view in elevation thereof.

Figure 11:
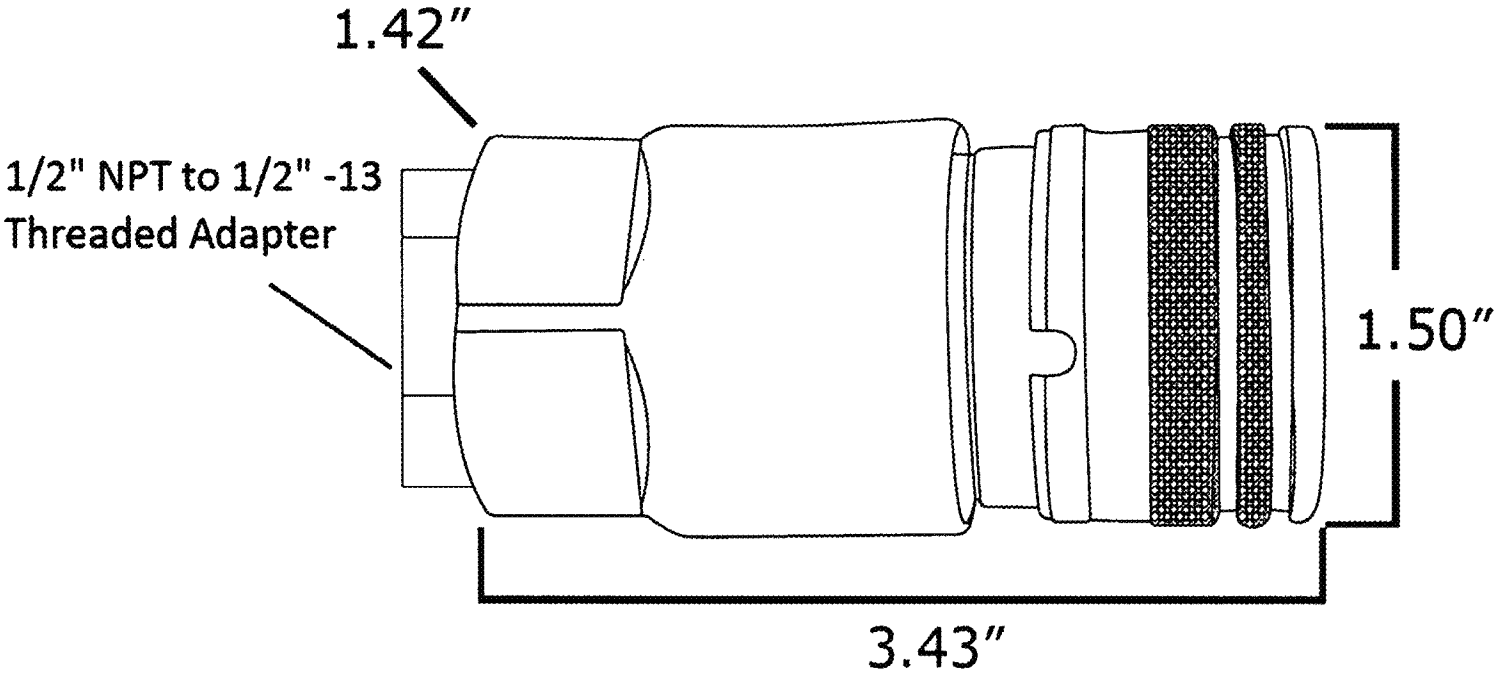

FIG. 11 is a side view in elevation of a ½ inch NPT case drain coupling installed using the installer/connector tool of the present invention.

Figure 12B:
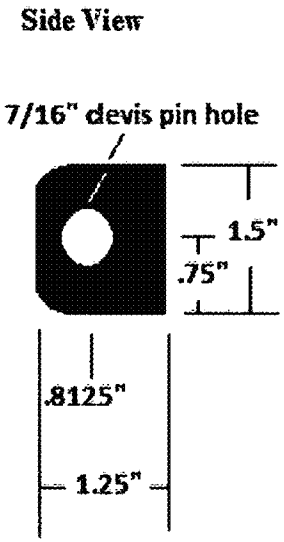
Figure 12A:
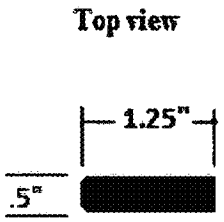

FIG. 12A is a top view of the handle pivot anchor;

FIG. 12B is a side view in elevation thereof.

Figure 13B:
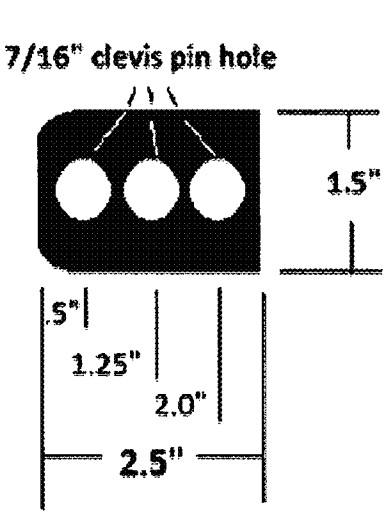
Figure 13A:
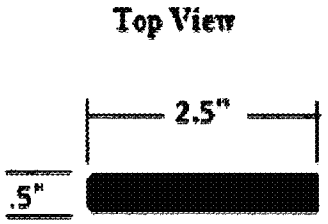

FIG. 13A is a top view of the end pivot anchor;

FIG. 13 B is a side view in elevation thereof.

Figure 14C:
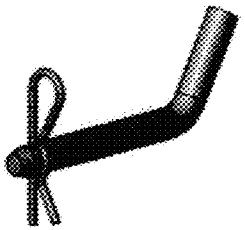
Figure 14B:
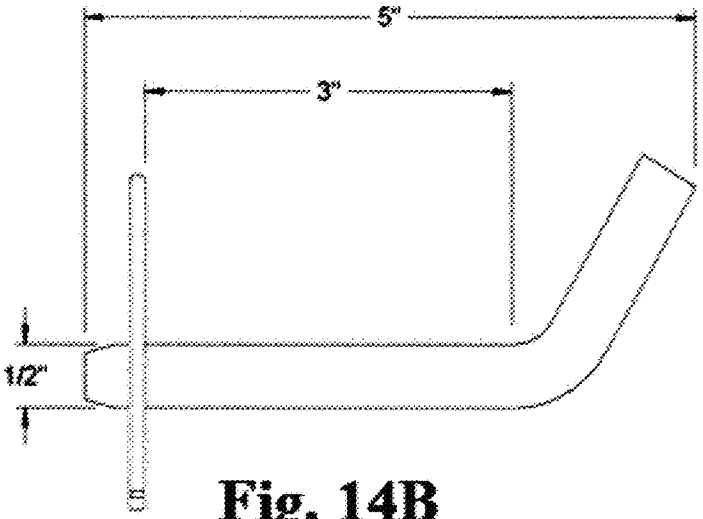
Figure 14A:
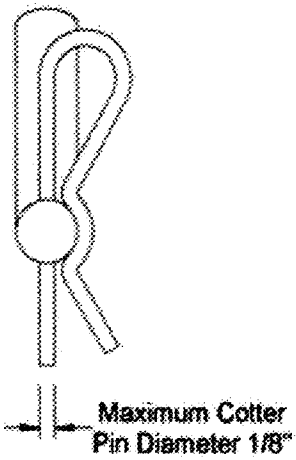

FIG. 14A is an end view showing the bent clevis pin used to couple the universal forcing adapter with the attachment swivel head;

FIG. 14B is a side view in elevation thereof;

FIG. 14C is an upper front perspective view thereof.

Figure 15B:
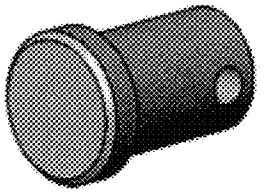
Figure 15A:
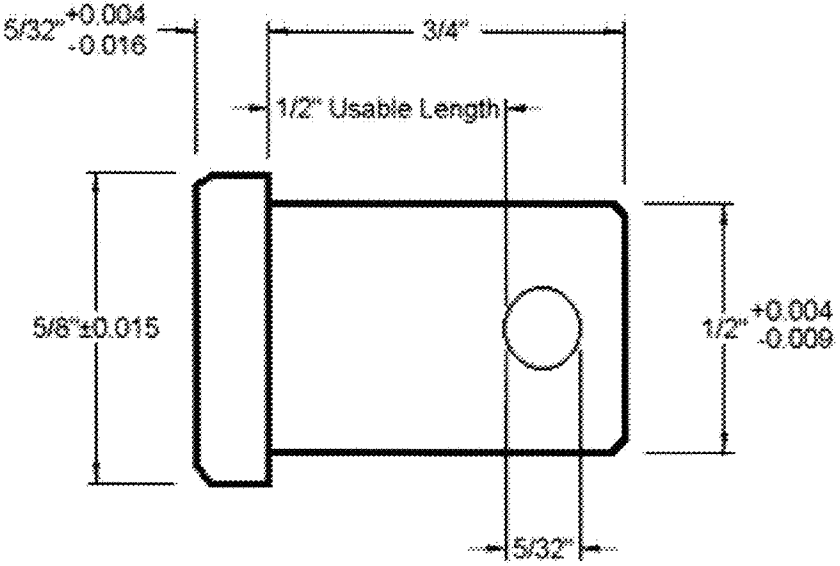

FIG. 15A is a side view in elevation of the clevis pin used, for example, in assembling the attachment angled swivel head with the single duty forcing adapter;

FIG. 15B is an upper rear perspective view thereof.

Figure 16C:
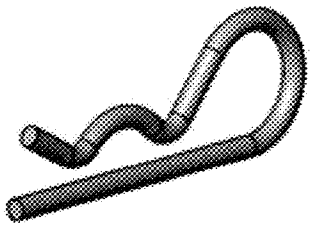
Figure 16B:
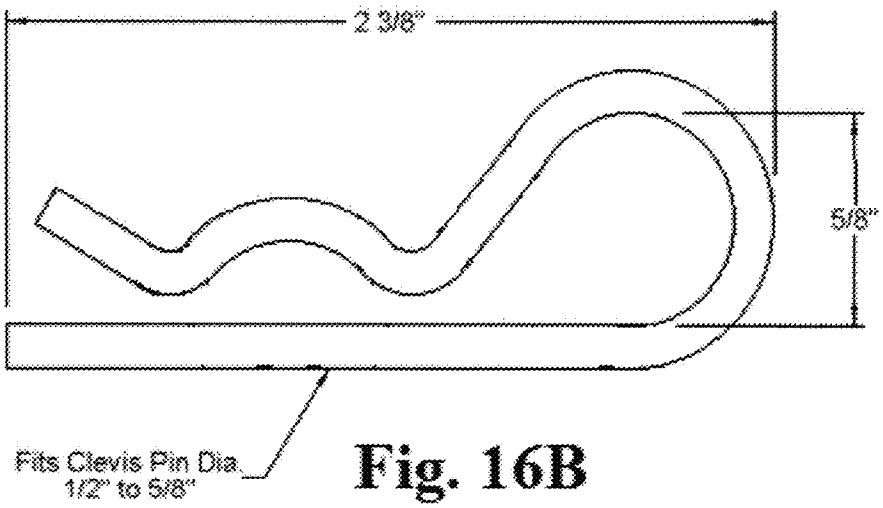
Figure 16A:
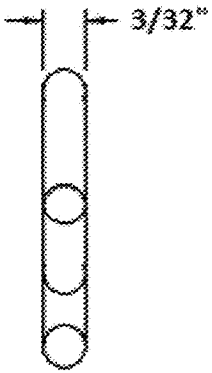

FIG. 16A is an end view in elevation of the hairpin used to secure the bent clevis pins used in assembly;

FIG. 16B is a side view in elevation thereof;

FIG. 16C is an upper front end view thereof.

Figure 17C:
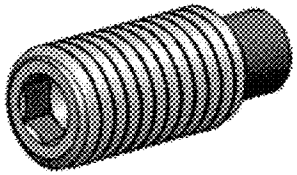
Figure 17B:
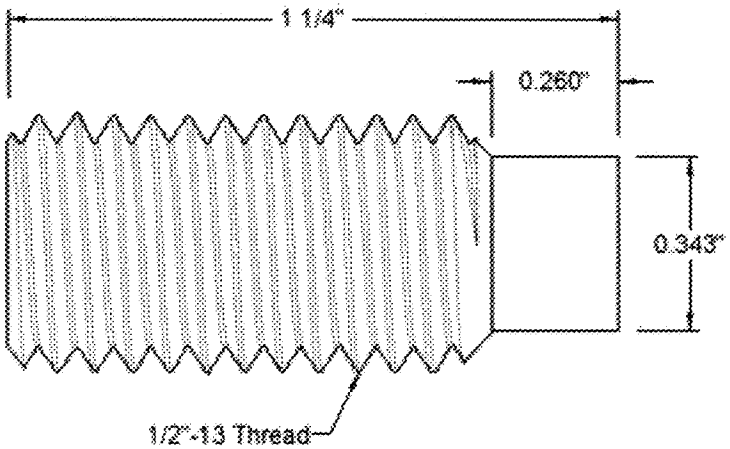
Figure 17A:
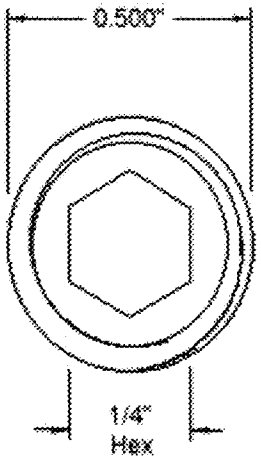

FIG. 17A is an end view in elevation of the extended tip set screw used in the swiveling single duty forcing head;

FIG. 17B is a side view in elevation thereof;

FIG. 17C is an upper rear view in elevation thereof.

Figure 18C:
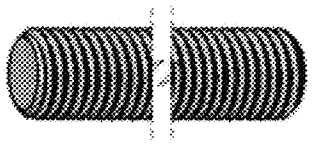
Figure 18B:
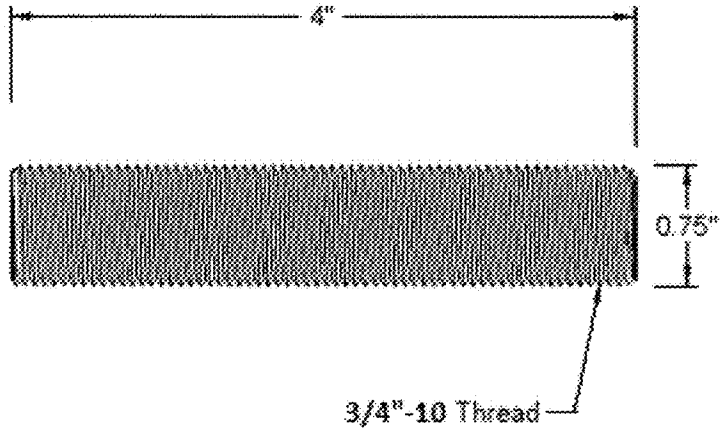
Figure 18A:
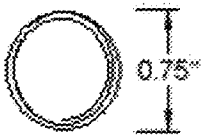

FIG. 18A is an end view of a grade 8 stud which is a component part of the attachment swivel heads;

FIG. 18B is a side view in elevation thereof;

FIG. 18C is an upper front end view thereof.

Figure 19D:
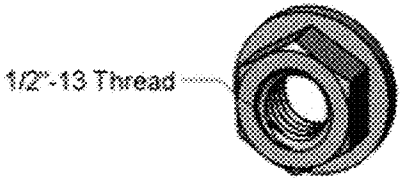
Figure 19C:
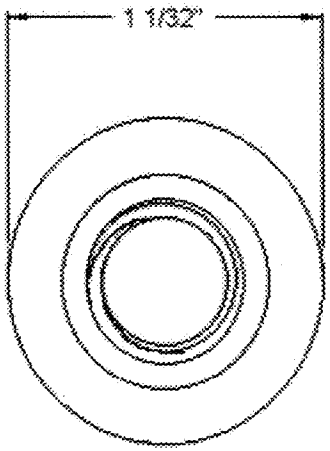
Figure 19B:
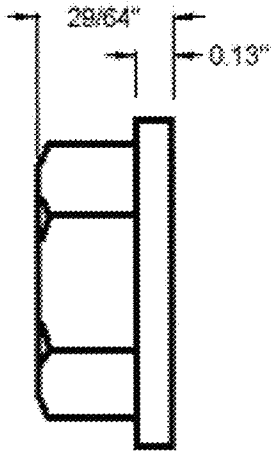
Figure 19A:
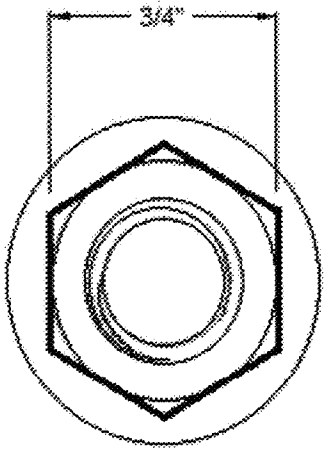

FIG. 19A is an end view in elevation of the flange nut which is a subcomponent of the handle;

FIG. 19B is a side view in elevation thereof;

FIG. 19C is a front end view thereof.

FIG. 19D is an upper perspective view thereof.

Figure 20C:
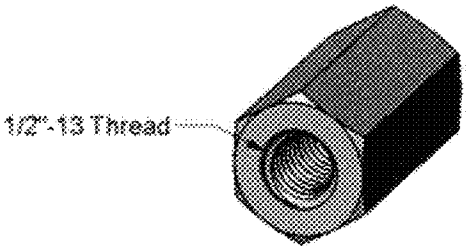
Figure 20B:
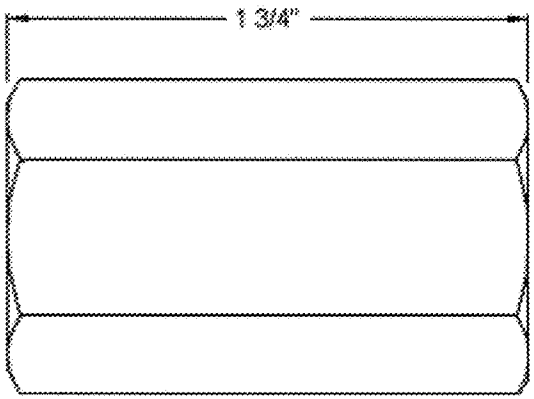
Figure 20A:
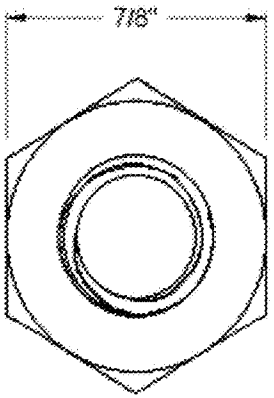

FIG. 20A is an end view in elevation of the ½ inch tall nut which is a subcomponent of the "J" hook attachment;

FIG. 20B is a side view in elevation thereof;

FIG. 20C is an upper perspective end view in elevation thereof.

Figure 21C:
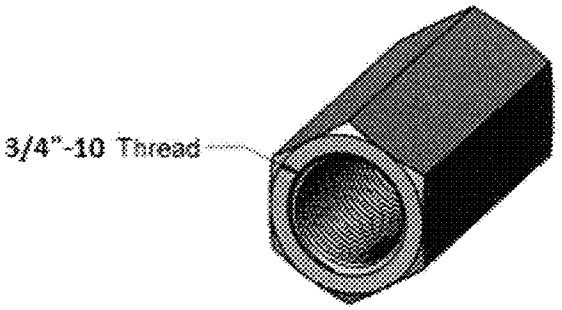
Figure 21B:
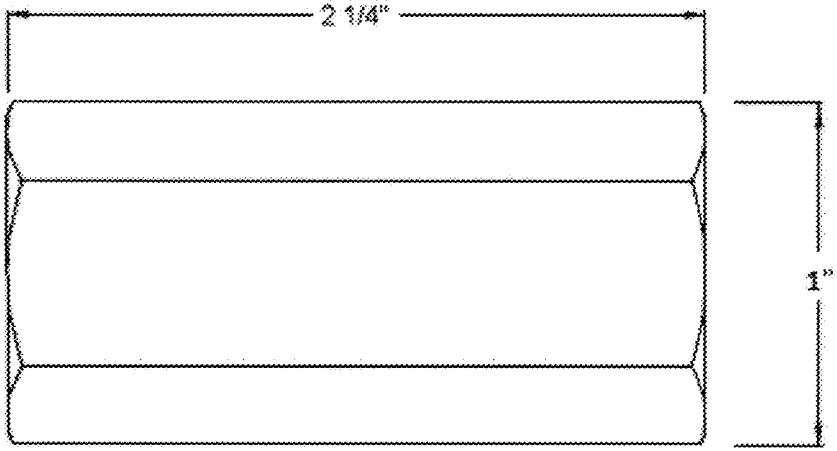
Figure 21A:
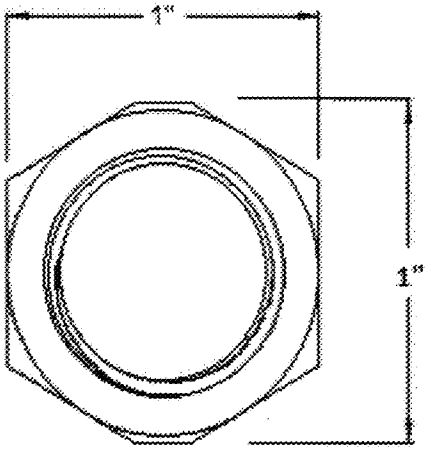

FIG. 21A is an end view in elevation of the ¾ inch tall nut which is a subcomponent of the "J" hook attachment;

FIG. 21B is a side view in elevation thereof;

FIG. 21C is an upper perspective end view in elevation thereof.

Figure 22C:
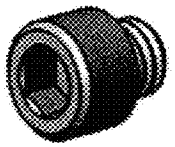
Figure 22B:
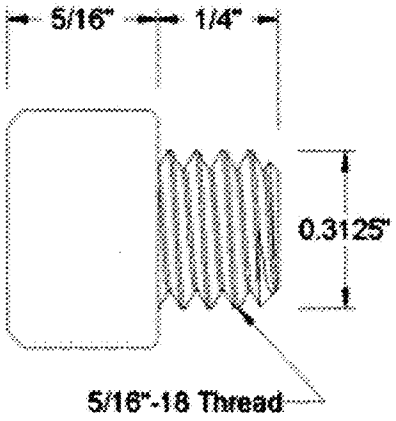
Figure 22A:
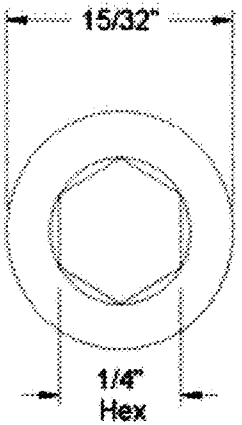

FIG. 22A is an end view in elevation of an allen bolt of the kind used as a subcomponent of the universal forcing head;

FIG. 22B is a side view in elevation thereof;

FIG. 22C is an upper rear end perspective view thereof.

Figure 23B:
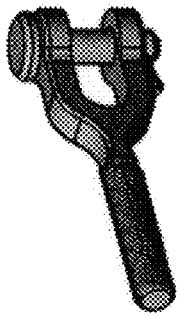
Figure 23A:
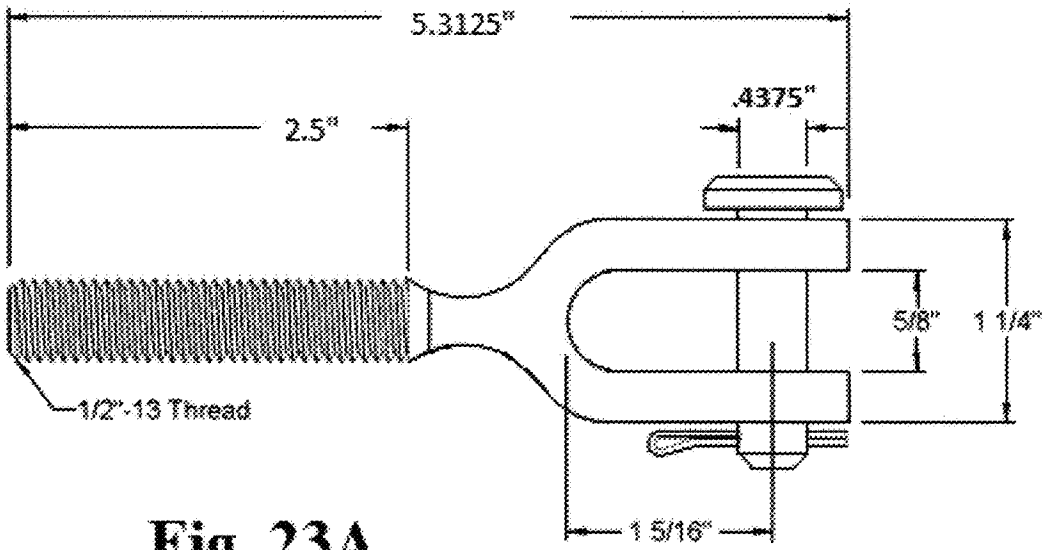

FIG. 23A is a top view of the short clevis that is an attachment component of the case drain coupler;

FIG. 23B is an upper front end perspective view thereof.

Figure 24B:
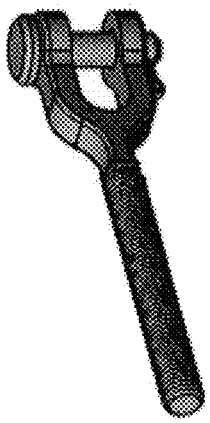
Figure 24A:
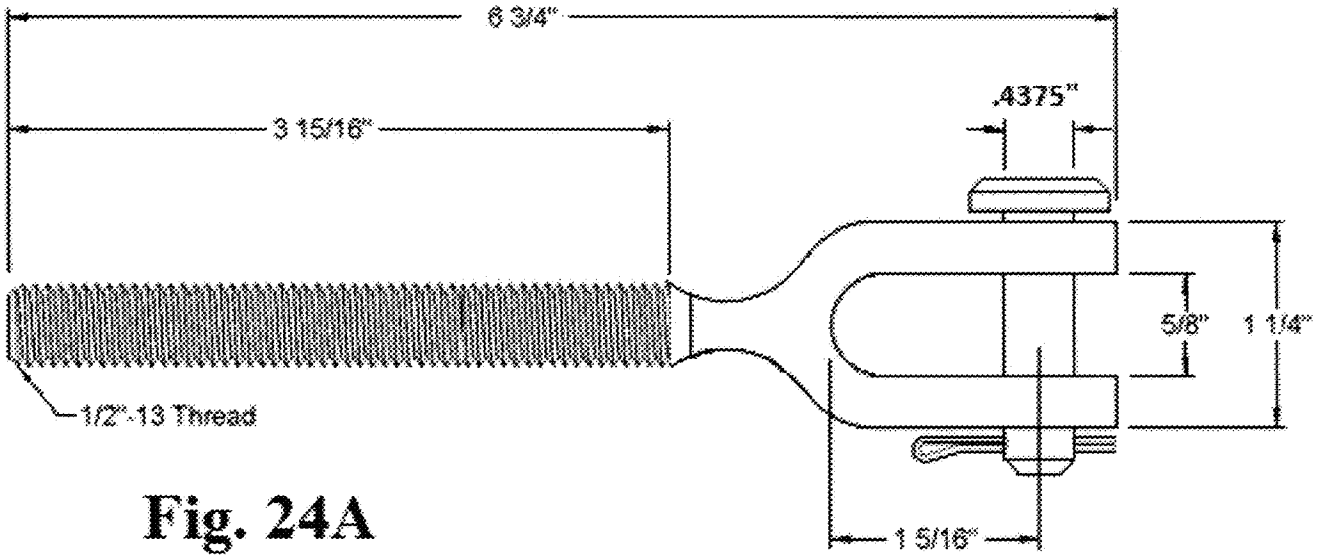

FIG. 24A is a top view of the long clevis that is an attachment component of the case drain coupler;

FIG. 24B is an upper front end perspective view thereof.

Figure 25C:
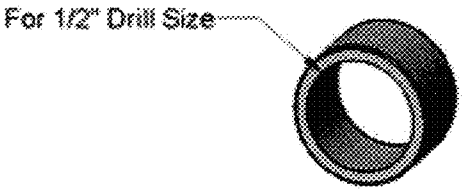
Figure 25B:
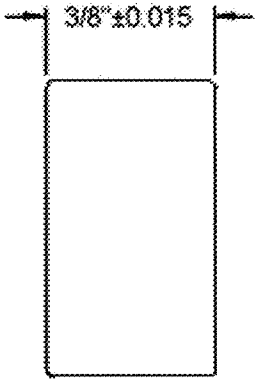
Figure 25A:
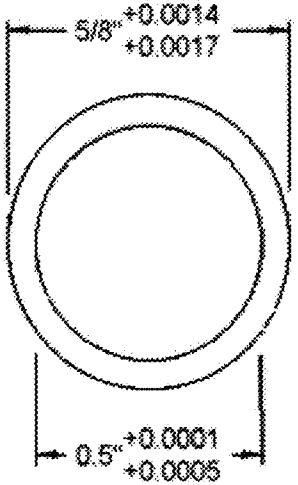

FIG. 25A is an end view of a bushing that is a subcomponent of the swiveling single duty forcing head;

FIG. 25B is a side view in elevation thereof;

FIG. 25C is an upper end perspective view thereof.

Figure 26C:
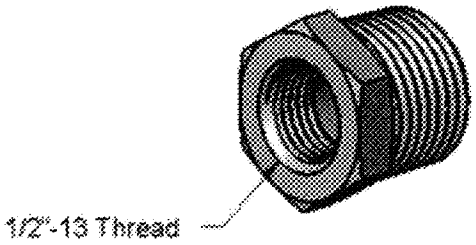
Figure 26B:
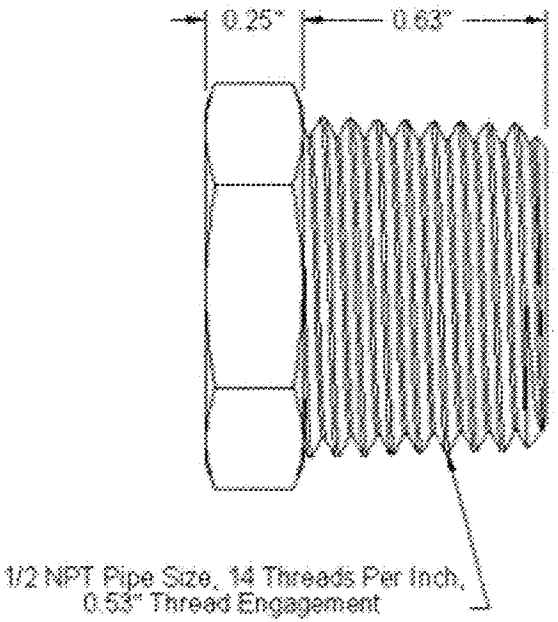
Figure 26A:
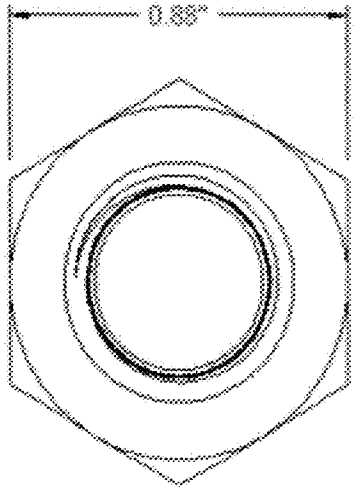

FIG. 26A is an end view in elevation of the ½ inch NPT to ½-13 threaded adapter which is a subcomponent of the case drain coupler;

FIG. 26B is a side view in elevation thereof;

FIG. 26C is an upper rear end perspective view thereof.

Figure 27:
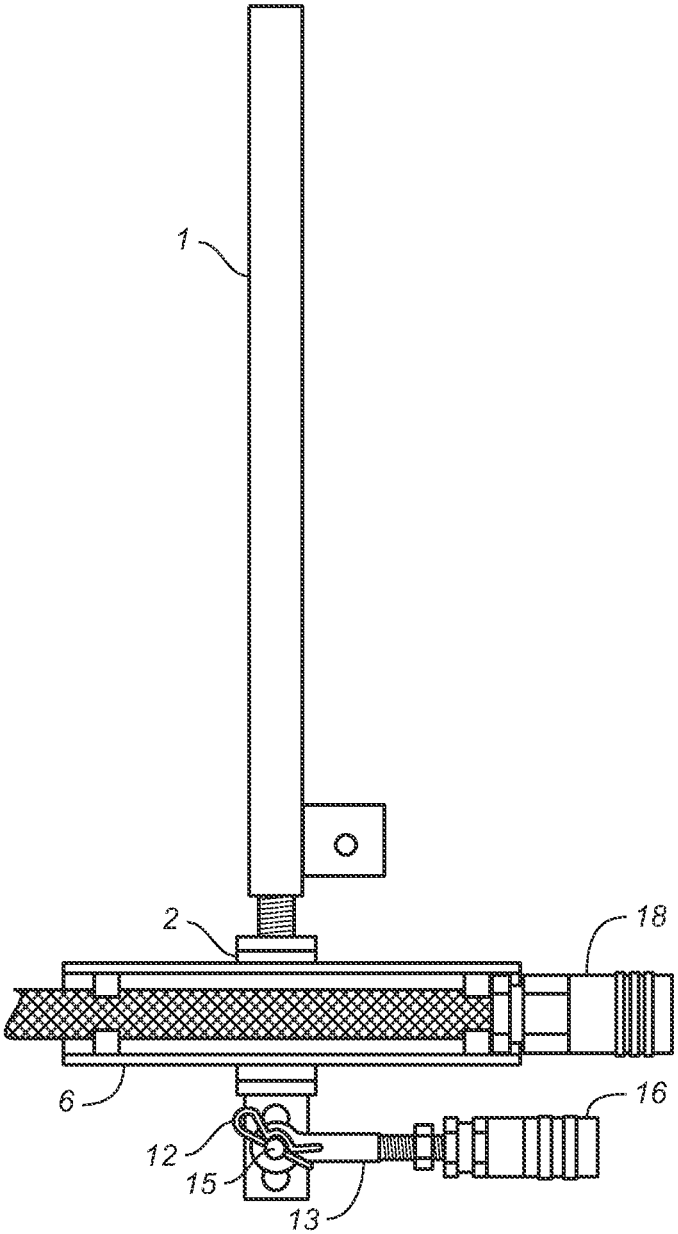

FIG. 27 is a lower perspective view showing the coupler configured with a handle, an angled attachment head threadably connected to the handle, a short anchor (clevis) pivotally connected to a clevis mount on the attachment head and threadably connected to a case drain coupling, a universal forcing head connected to the attachment head, and a loose coupling and hydraulic line disposed in the channel of the universal installer head.

Figure 28:
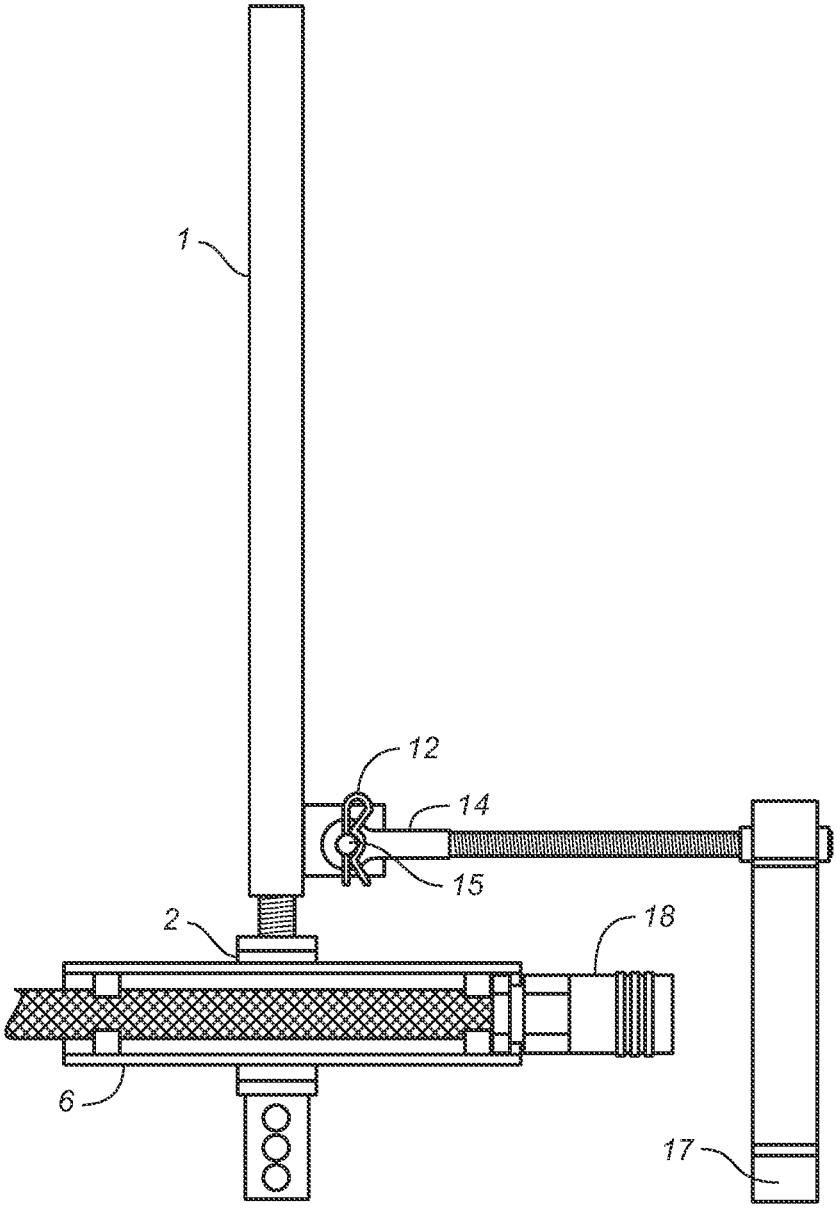

FIG. 28 is a lower perspective view showing a variation on the configuration of FIG. 27, this view showing the short anchor and case drain coupling replaced by a long anchor (clevis) and 'J' hook, wherein the long anchor is pivotally connected to the handle clevis mount.

Figure 29:
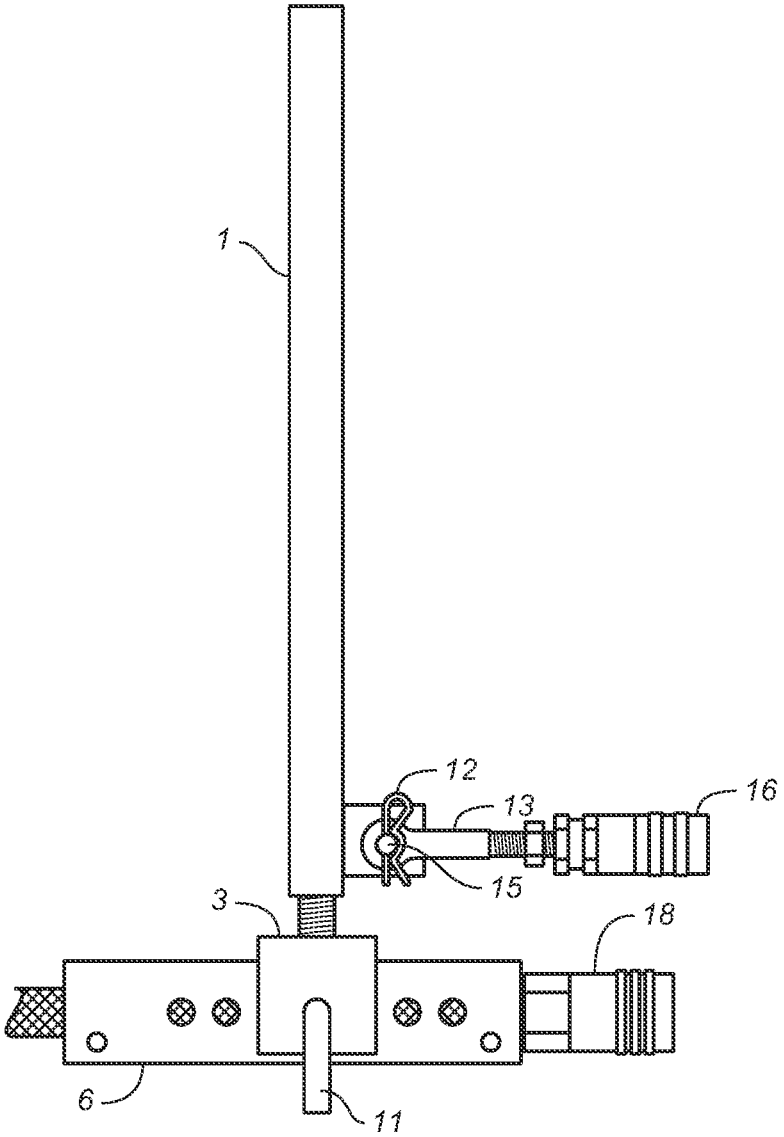

FIG. 29 is a lower perspective view showing the basic coupler configured with the handle pivotally connected to a short anchor (clevis) and case drain coupling, an attachment swivel head without bushings, a universal installer head connected to the attachment swivel head, and a loose coupling and hydraulic line disposed in the channel of the attachment swivel head.

Figure 30:
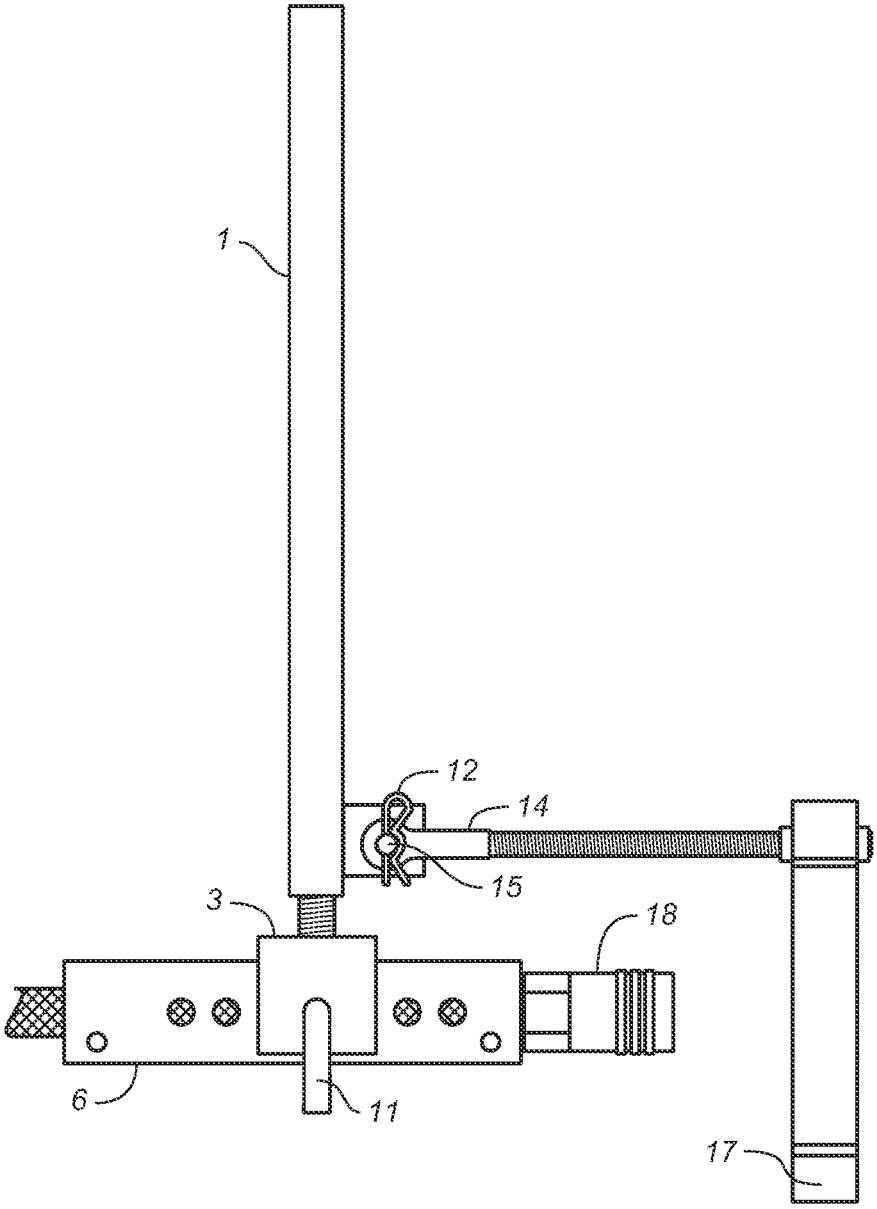

FIG. 30 is a lower perspective view showing the same configuration with the short anchor and case drain coupling replaced by a long anchor (clevis) and 'J' hook.

Figure 31:
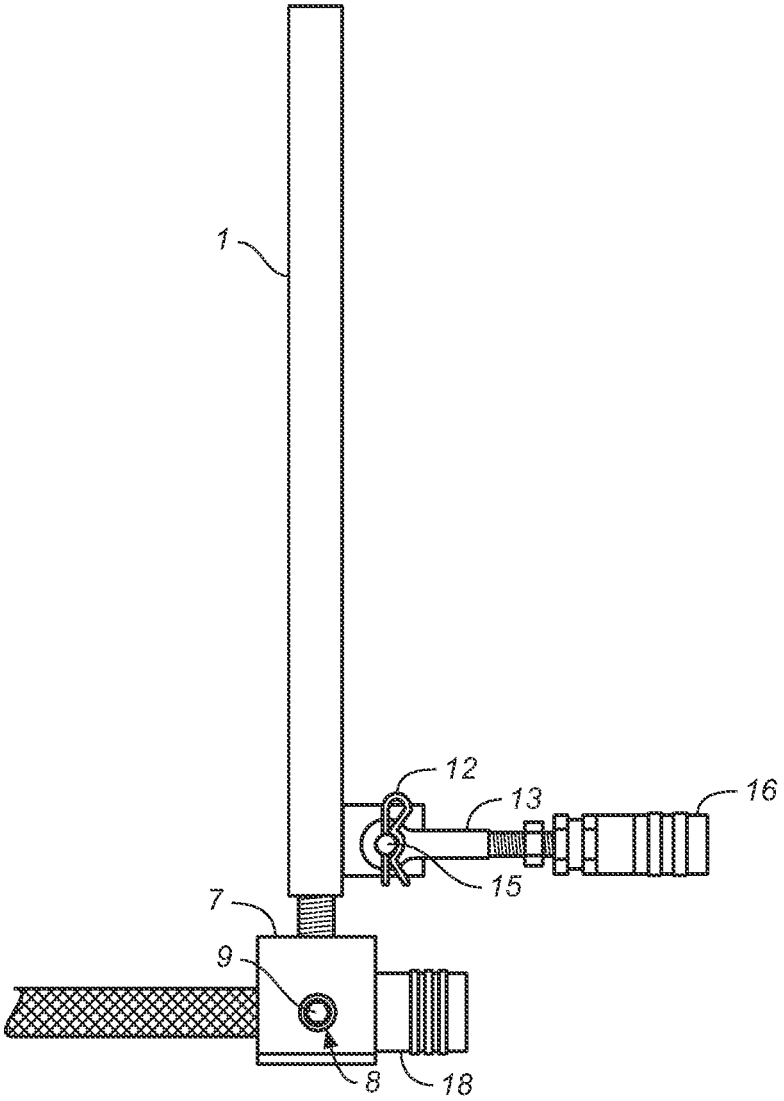

FIG. 31 is a lower perspective view showing the basic coupler configured with the handle pivotally connected to a short anchor (clevis) and case drain coupling, an attachment swivel head with bushings threadably connected to the handle, a swiveling installer head connected to the attachment swivel head, and a loose coupling and hydraulic line disposed in the channel of the swiveling installer head.

Figure 32:
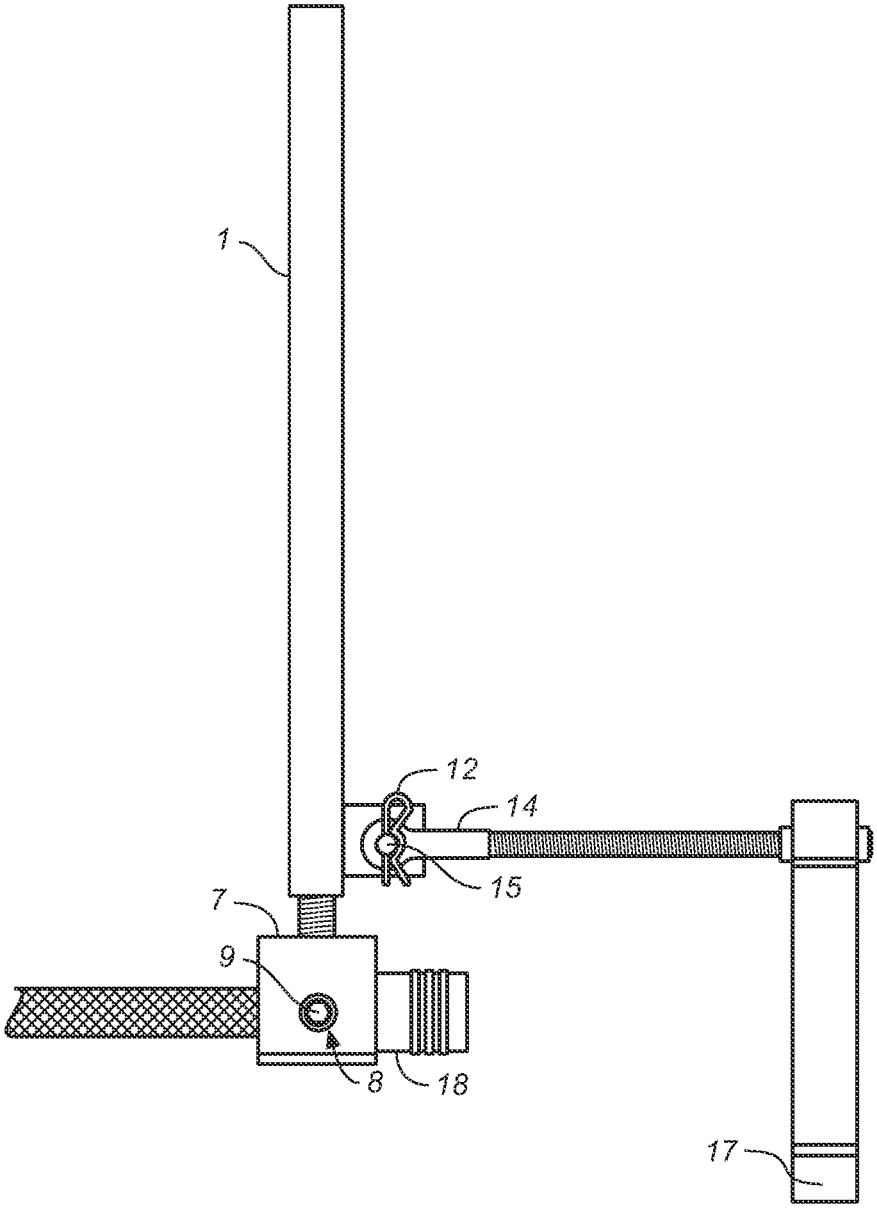

FIG. 32 is the same configuration with the short anchor and case drain coupling replaced by a long anchor (clevis) and 'J' hook.

DRAWING LEGEND

Ref. # Description

1. Tool Handle with ¾" Threaded Insert and Pivot Anchor
2. Attachment Angled Swivel Head with Three Hole Position Pivot Anchor
3. Attachment Swivel Head No Bushings
4. Attachment Swivel Head with Bushings
5. Single Duty Forcing Adapter
6. Universal Forcing Adapter with 5/16" Allen Bolts
7. Swiveling Single Duty Forcing Adapter
8. ½"×⅝" Bushing
9. ½" Extended Cap Screw
10. ½"×½" Clevis Pin
11. ½"×3" Bent Clevis Pin
12. 3/32" Hair Pin
13. ½"×4" Threaded Clevis
14. ½"×12" Threaded Clevis
15. ⅜"×1¾" Clevis Pin
16. ½" Case Drain Coupler Anchor with Threaded Adapter
17. "J" Hook Anchor with Threaded Coupling
18. Not Part of Invention-Equipment Hose and Coupling being installed

DETAILED DESCRIPTION OF THE INVENTION

Compact Excavator & Skid Steer Loader Auxiliary Hydraulic Coupler Installer Tool Manufacture, Assembly Process and Use of Tool Step 1. Cut materials to lengths as follows:

a. 0.5"×1.5" flat bar to 1.25" length for 'Handle Pivot Anchor' (FIG. 12A-FIG. 12B).
b. 0.5"×1.5" flat bar to 2.25" length for 'End Pivot Anchor' (FIG. 13A-FIG. 13B).
c. 1"×1" ID square tubing to 18" length for 'Tool Handle' (FIG. 3A-FIG. 3B),
d. 4"×3"×0.25" wall square tubing to 1.5" length for 'Attachment Angled Swivel Head' (FIG. 4A-FIG. 4B),
   1. Cut 4" length of tube at 2" to create (2) 2"×3"×1.5" "U" channels.
e. 2.5"×2.5"×0.25" wall square tubing to 1.5" length for 'Attachment Swivel Head With and Without Bushings' (FIG. 5A-FIG. 5B & FIG. 6A-FIG. 6B),
   1. Cut seam side of tubing off the create 2.5"×2.25"×1.5" 'Attachment Swivel Head (FIG. 5A-FIG. 5B & FIG. 6A, FIG. 6B),
f. Remove hex head of ¾"-10×4" grade 8 bolt to create stud ¾"-10×4" (FIG. 18A-FIG. 18B-FIG. 18C),
g. 4"×2"×0.25" wall square tubing to 1.5" length for 'Single Duty Forcing Head' (FIG. 7A-FIG. 7B) or 'Swiveling Single Duty Forcing Head' (FIG. 8A-FIG. 8B).
   1. Cut 4" length of tube at 2" to create (2) 2"×2"×1.5" "U" channel Forcing Heads in (FIG. 7A-FIG. 7B & FIG. 8A-FIG. 8B).
h. 4"×2"×0.25" wall square tubing to 9.5" length for 'Universal Forcing Adapter' (FIG. #9).
   1. Cut 4" length of tube at 2" to create (2) 2"×2"×9.5" "U" channel for 'Universal Forcing Adapter' (FIG. 9A-FIG. 9B-FIG. 9C), i. 0.25" round stock to 1.25" for 'Welded Dowel Pins' in 'Single Duty Forcing Head' (FIG. 7A-FIG. 7B).

j. 1"×0.25" flat bar to 11" length for hook of ' "J" Hook Attachment' (FIG. 10A-FIG. 10B).

Step 2. Prep. materials for assembly and welding:

a. Grind 2 opposing pinnacles from ¾"-10 tall nut (FIG. 21A-FIG. 21B-FIG. 21C).

b. Deburr and grind all corners of cut materials to rounded corners and edges in preparation for welding.

c. Locate, center punch and drill 0.4375" hole at 0.75"× 0.8125" in 0.5"×1.5"×1.25" flat bar for "Handle Pivot Anchor" from Step 1 (a) (FIG. 12A-FIG. 12B).

d. Locate, center punch and drill (3) 0.4375" holes at 0.75"×0.5" at 0.75×1.125" at 0.75"×1.75" in 0.5"× 1.5"×2.25" flat bar for 'End Pivot Anchor' from Step 1 (b) (FIG. 13A-FIG. 13B).

e. Locate, center punch and drill (4) 0.375" holes (holes are on opposing sides) (2) at 0.75" (top and bottom) and (2) at 1.5" (each side) of 1"×1"×18" long square tubing 'Tool Handle' from Step 1 (c) to provide weld mounting of ¾"-10 tall nut (FIG. 21A-FIG. 21B-FIG. 21C) inside 'Tool Handle' (FIG. 13A-FIG. 13B).

f. Locate, center punch and drill 0.5 hole at 0.75"×1.5" in the 3" side (bottom) of the 2"×3"×15."×0.25" wall "U" channel from Step 1 (d)(1) (FIG. 4A-FIG. 4B), g. Locate, center punch and drill (2) 0.5" holes in opposing sides of 2.5"×2.25"×1.5" "U" channel from Step 1 (e)(1) at 0.625"×0.75" for 'Attachment Swivel Head with no Bushings' (FIG. 6A-FIG. 6B).

1. Locate, center punch and drill (2) 0.625" holes in 2.5"×2.25"×1.5" "U" channel from Step 1 (e)(1) in the same locations for 'Attachment Swivel Head with Bushings' (FIG. 5A-FIG. 5B).

h. Locate, center punch and drill 0.5 hole at 0.75"×1.0" in the 2" side (bottom) of the 2"×2"×15."×0.25" wall "U" channel from Step 1 (g)(1) for 'Single Duty Forcing Head' (FIG. 7A-FIG. 7B).

1. Locate, center punch and drill (2) 0.4375 holes in opposing sides of "U" channel from Step 1 (g)(1) at 0.625"×0.75" and thread holes to ½"-13 for 'Swiveling Single Duty Forcing Head' (FIG. 8A-FIG. 8B).

i. Locate, center punch and drill (7) 0.5 holes (holes in opposing sides as follows) at 1"×2" at 1"×3" at 1"×4" at 1"×5" at 1"×6" at 1"×7" at 1"×8" of the 2"×2"×9.5"× 0.25" wall "U" channel from Step 1 (h)(1) (FIG. 9A-FIG. 9B-FIG. 9C).

j. Locate, center punch and drill (4) 0.25 holes (holes in opposing sides as follows) at 0.75"×0.5" from open face of "U" channel on both of the 2"×2"×9.5"×0.25" wall "U" channel from Step 1 (h)(1). Thread these 4 holes to 5/16"-18 (FIG. 9A-FIG. 9B-FIG. 9C).

k. Locate, center punch and drill (2) 0.25 holes (holes in bottom of "U" channel as follows) at 1" center×0.75" from bottom and top of "U" channel on 2"×2"×9.5"× 0.25" wall "U" channel from Step 1 (h)(1). Thread these 2 holes to 5/16"-18 (FIG. 9A-FIG. 9B-FIG. 9C).

l. Locate, center punch and drill (7) 0.5 holes (holes in bottom of "U" channel as follows) at 1"×2" at 1"×3" at 1"×4" at 1"×5" at 1"×6" at 1"×7" at 1"×8" of the 2"×2"×9.5"×0.25" wall "U" channel from Step 1 (h)(1) (FIG. 9A-FIG. 9B-FIG. 9C).

m. Bend one end of the 1"×0.25"×11" flat bar (step 1(j)) into a 2.5" wide "J" hook (FIG. 10A-FIG. 10B). Leaving a 6" long end to be shaped for the installation and welding of the ½"-13 tall nut (FIG. 20A—FIG. 20B-FIG. 20C).

1. Bend opposite end of 'J' Hook (FIG. #10) 45 degrees away from open end of hook and then into a ⅞" opening circle toward the hook to receive the ½"-13 tall nut (FIG. 20A-FIG. 20B-FIG. 20C).

n. After all components have been cut and drilled and shaped. Deburr and grind smooth.

Step 3. Assembly and welding of 'Handle' components: (FIG. 3A-FIG. 3B).

a. Install ¾"-10 tall nut (FIG. 21A-FIG. 21B-FIG. 21C) into 1" square tubing at end with (4) 0.375 drilled holes in Step 2 (e) to a depth of 0.25" below the face of the tube and plug weld all 4 predrilled holes to the inserted tall nut (FIG. 21A-FIG. 21B-FIG. 21C).

b. Locate "Handle Pivot Anchor" from Step 2 (c) (FIG. 12A-FIG. 12B) on center line of handle (FIG. 3A—FIG. 3B) at tall nut (FIG. 21A-FIG. 21B-FIG. 21C) end and 0.0625" back from face of the tube and weld on both sides of the anchor (FIG. 12A-FIG. 12B) parallel to the handle length.

c. Let cool and chase tall nut (FIG. 21A-FIG. 21B-FIG. 21C) threads.

Step 4. Assembly and welding of 'Attachment Angled Swivel Head': (FIG. 4A-FIG. 4B)

a. On the opposite ends of the 2"×3"×15."×0.25" wall "U" channel from Step 2 (f). Locate center on both 2"×1.5" ends.

b. Center and weld the ¾"-10 grade 8 stud (FIG. 18A-FIG. 18B-FIG. 18C) from Step 1 (f) to one of the 2"×1.5" ends of the "U" channel.

c. Center and weld 'End Pivot Anchor' (FIG. 13A-FIG. 13B) from Step 2 (d) parallel to the 3" opening of the opposite 2"×1.5" end of the "U" channel from the ¾"-10 grade 8 stud (FIG. 18A-FIG. 18B-FIG. 18C) end from Step 4 (b).

Step 5. Assembly and welding of 'Attachment Swivel Head': (No Bushing (FIG. 6A-FIG. 6B) and With Bushing (FIG. 5A-FIG. 5B).

a. Center and weld the ¾"-10 grade 8 stud (FIG. 18A-FIG. 18B-FIG. 18C) from Step 1 (f) to outside bottom end of 2.5"×2.25"×1.5" "U" channel from Step 2 (g) for No Bushing (FIG. 6A-FIG. 6B).

b. Center and weld the ¾"-10 grade 8 stud (FIG. 18A-FIG. 18B-FIG. 18C) from Step 1 (f) to outside bottom end of 2.5"×2.25"×1.5" "U" channel from Step 2 (g)(1) for With Bushing (FIG. 5A-FIG. 5B).

Step 6. Assembly and welding of the 'Single Duty Forcing Head': (FIG. 7A-FIG. 7B)

a. Locate center on the opposing sides of the 2"×2"×15."× 0.25" wall "U" channel from Step 2 (h).

b. Clamp 0.25"×1.25" dowel pins from Step 1 (i) to both inside legs of the "U" channel on centerlines and tack weld in 2 places on one side of each of the dowel pins.

Step 7. Assembly of the 'Swiveling Single Duty Forcing Head': (FIG. 8A-FIG. 8B)

a. On the 2"×2"×15."×0.25" wall "U" channel from Step 2 (h)(1) assemble ½"-13 long tip set screw (FIG. #17), 0.5"×ID>0.625" OD>0.375" long bushing (FIG. 25A-FIG. 25B-FIG. 25C) and ½"-13 flange nut (FIG. 19A-FIG. 19B-FIG. 19C-FIG. 19D) into threaded holes and tighten flange nut (FIG. 19A-FIG. 19B-FIG. 19C-FIG. 19D) flush with set screw head (FIG. 17A-FIG. 17B-FIG. 17C).

b. Weld set screw head (FIG. 17A-FIG. 17B-FIG. 17C) to flange nut (FIG. 19A-FIG. 19B-FIG. 19C-FIG. 19D).

c. Repeat process for opposite side.

Step 8. Assembly of the 'Universal Forcing Adapter': (FIG. 9A-FIG. 9B-FIG. 9C).

a. Thread all (6) of the 0.25" drilled holes at both ends of the 9.5" long "U" channel from Step 2(j) and Step 2(k) to 5/16"-18 thread.
b. Insert (6) 5/16"-18×0.25" Allen bolts (FIG. 22A-FIG. 22B-FIG. 22C) with thread lock and tighten.

Step 9. Assembly and welding of the '"J" Hook Attachment': (FIG. 10A-FIG. 10B)

a. Insert ½"-13 threaded tall nut (FIG. 20A-FIG. 20B-FIG. 20C) into the ⅞" opening created in Step 2 (l)(1) and weld both inside portions of ⅞" opening.
b. Let cool and chase ½"-13 threads in tall nut (FIG. 20A-FIG. 20B-FIG. 20C).
c. Thread 4" threaded clevis (FIG. 24A-FIG. 24B) into "J" hook tall nut (FIG. 20A-FIG. 20B-FIG. 20C).

Step 10. Assembly of 'Case Drain Coupling Anchor': (FIG. 11).

a. Thread ½" NPT to ½"-13 adapter (FIG. 26A-FIG. 26B-FIG. 26C) into ½" case drain coupling (FIG. 11).
b. Thread 2.5" threaded clevis (FIG. 23A-FIG. 23B) into coupling adapter (FIG. 26A-FIG. 26B-FIG. 26C).

Assembly and Use of the Tool

To assemble the tool for use with the 'Angled Swivel Head' as drawn in (FIG. 1A-FIG. 1B) simply choose the forcing adapter (FIG. 7A-FIG. 78 or FIG. 9A-FIG. 9B-FIG. 9C) for the application and install it in the 'Attachment Angled Swivel Head' (FIG. 4A-FIG. 4B) using the ½"×½" clevis pin (FIG. 15A-FIG. 15B) and hairpin (FIG. 16A-FIG. 16B-FIG. 16C). Then choose the anchor for the application (either the 'Case Drain Coupling (FIG. 11) Anchor' or the ' "J" Hook Attachment' (FIG. 10A-FIG. 10B) Anchor and install it on either the 'End Pivot Anchor' in (FIG. 4A-FIG. 4B) or the 'Handle Pivot Anchor' in (FIG. 3A-FIG. 3B) using the 7/16" clevis pin in (FIG. 23A-FIG. 23B or FIG. 24A-FIG. 24B). and hairpin (FIG. 16A-FIG. 16B-FIG. 16C).

To assemble the tool for use with the 'Swivel Head No Bushing' (FIG. 6A-FIG. 6B) or 'Swivel Head with Bushings' (FIG. 5A-FIG. 5B) simply choose the forcing adapter (FIG. 7A-FIG. 7B, FIG. 8A-FIG. 88 or FIG. 9A-FIG. 9B-FIG. 9C) for the application and install it in the corresponding 'Attachment Swivel Head' (FIG. 6A-FIG. 6B or FIG. 5A-FIG. 5B) using the ½"×3" clevis pin (FIG. 15A-FIG. 15B) and hairpin (FIG. 16A-FIG. 16B-FIG. 16C) or threaded setscrews and bushings (FIG. 8A-FIG. 8B). Then choose the anchor for the application (either the 'Case Drain Coupling Anchor' (FIG. 11) or the '"J" Hook Attachment' (FIG. 10A-FIG. 10B)) and install it on the 'Handle Pivot Anchor' (FIG. 3A-FIG. 3B) using the 7/16" clevis pin in (FIG. 23A-FIG. 23B or FIG. 24A-FIG. 24B) and hairpin (FIG. 16A-FIG. 16B-FIG. 16C).

To Install the tool on the machine simply choose the appropriate 'Anchor Attachment' for the application. For the ' "J" Hook Attachment' (FIG. 10A-FIG. 10B) place the hook over the auxiliary lines behind their mounting bracket on the machine and adjust as needed. For the 'Case Drain Coupling Anchor' (FIG. 11). First determine whether the handle pivot in (FIG. 3A-FIG. 3B) or the end pivot in (FIG. 4A-FIG. 4B) are appropriate and pin the anchor to the appropriate pivot point. Next couple the anchor coupling (FIG. 11) to the auxiliary case drain coupling on the machine and adjust as needed.

Once the tool is in place adjustments can be made by extending the Attachment Angled Swivel Head (FIG. #4) or moving the Anchor Attachment on the End Pivot Anchor (FIG. #4). Additional adjustments can be made by screwing the Anchor Attachment ('J' Hook (FIG. 10A-FIG. 10B) or 'Case Drain Coupler (FIG. 11)) on or off the threaded clevis (FIG. 23A-FIG. 23B or FIG. 24A-FIG. 24B).

Once the tool has been adjusted and attached to the machine. Place the auxiliary hydraulic attachment coupler in the 'Forcing Head' (FIG. 7A-FIG. 7B/FIG. 8A-FIG. 8B or FIG. 9A-FIG. 9B-FIG. 9C) and align the coupler with the mating hydraulic coupler on the machine. Push or pull on the tool handle (depending on the application) to push the auxiliary hydraulic attachment coupling towards the machine hydraulic coupling until it snaps into place. Once the hydraulic coupling is in place, rotate the female coupling collar to lock the hydraulic couplings together.

Remove and store the tool or reset and reconfigure the tool for the next hydraulic coupler to be installed.

The invention claimed is:

1. A compact excavator and skid steer loader auxiliary hydraulic coupler installer tool, comprising:

an elongate handle having a gripping portion at a first end, a threaded opening at a second end, and an integral pivot anchor proximate the threaded opening;

a plurality of U-shaped attachment heads, each having a male threaded post for screwing into the threaded opening of the handle, the attachment heads selected from a group consisting of an angled attachment head, an attachment swivel head with bushings, and an attachment swivel head without bushings; and a plurality of forcing adapters each configured for attachment to one of the attachment heads and to hold and translate and attachment coupler fitting (either male or female) to be connected to a hydraulic coupling on a compact excavator or skid steer, the forcing heads selected from a group consisting of a universal forcing adapter, a single duty forcing adapter, and a swiveling forcing adapter.

* * * * *